US007692328B2

(12) United States Patent
Yoshida et al.

(10) Patent No.: US 7,692,328 B2
(45) Date of Patent: Apr. 6, 2010

(54) POWER UNIT OF UNDERWATER VEHICLE

(75) Inventors: Hiroshi Yoshida, Miura-gun (JP); Taro Aoki, Zushi (JP); Fumihiko Endo, Fujinomiya (JP); Takayoshi Watanabe, Fujiyoshida (JP); Katsuki Fujimoto, Osaka (JP); Osamu Numamoto, Osaka (JP)

(73) Assignee: Japan Agency for Marine-Earth Science and Technology, Yokosuka-shi (JP)

( * ) Notice: Subject to any disclaimer, the term of this patent is extended or adjusted under 35 U.S.C. 154(b) by 94 days.

(21) Appl. No.: 11/770,053

(22) Filed: Jun. 28, 2007

(65) Prior Publication Data

US 2009/0001810 A1 Jan. 1, 2009

(51) Int. Cl.
*B60L 1/00* (2006.01)

(52) U.S. Cl. ..... 307/9.1

(58) Field of Classification Search ..... 307/9.1, 307/145; 324/347, 348; 405/185, 188
See application file for complete search history.

(56) References Cited

U.S. PATENT DOCUMENTS 4,009,452 A * 2/1977 Waltz et al. ..... 331/68
6,031,737 A * 2/2000 Green ..... 363/37
6,437,996 B1 * 8/2002 Wobben ..... 363/37
6,456,179 B1 * 9/2002 Backa et al. ..... 336/57
2007/0289367 A1 * 12/2007 Aubin et al. ..... 73/73
2008/0007265 A1 * 1/2008 Milne et al. ..... 324/347
2008/0105562 A1 * 5/2008 Simpson et al. ..... 205/724

FOREIGN PATENT DOCUMENTS

JP 9-272494 A 10/1997

OTHER PUBLICATIONS

Petitt et al., Power System for the New Jason ROV, Nov. 2004, Oceans '04. MTTS/IEEE Techno-Ocean '04, vol. 3, pp. 1727-1731.*

* cited by examiner

*Primary Examiner*—Fritz M Fleming
*Assistant Examiner*—Daniel Cavallari
(74) *Attorney, Agent, or Firm*—Crowell & Moring LLP

(57) ABSTRACT

The present invention provides a power unit of an underwater vehicle, which allows reduction in size and weight of a transformer for stepping down a power voltage of a power supply to increase a loading amount of a variety of devices with respect to the underwater vehicle, so as to obtain a favorable operating environment. The power unit is connected to the power supply through a cable and receives power through the cable. Further, the power unit comprises an electronic transformer having: a rectifier for rectifying a high-voltage alternate current power of the power supply into a direct current; a high-frequency converter for converting an output of the rectifier into a high-frequency alternate current; a transformer for stepping down an output voltage of the high-frequency converter; a rectifier for rectifying an output of the transformer into a direct current; and a control circuit for controlling the high-frequency converter.

1 Claim, 2 Drawing Sheets

POWER UNIT OF UNDERWATER VEHICLE

BACKGROUND OF THE INVENTION

The present invention relates to a power unit of an underwater vehicle.

Underwater vehicles used for investigation, search and the like in the sea and water are broadly classified into an untethered type underwater vehicle which operates automatically and a tethered type underwater vehicle connected with a mother vessel which conveys and operates the underwater vehicle through a cable as disclosed for example in JP-A-H09-272494. Each of the underwater vehicles is used in a scene according to its characteristic.

Out of those underwater vehicles, the cable type underwater vehicle has the advantage of being capable of easily performing power supply and information communication through a cable since it is connected with the mother vessel through the cable.

However, in recent years, the development is underway on an underwater vehicle which enables search at a depth as great as about 10 km, and the like. Such an underwater vehicle requires a cable about twice as long as the depth in consideration of water flow and the like. When power is supplied using such a long cable, electric resistance is naturally large, and hence a high voltage power supply is installed on the mother vessel so as to reduce voltage drop (power loss).

When the high voltage power supply is used, it is necessary on the underwater vehicle side to decrease the voltage according to devices loaded thereon, and for this reason, a transformer is loaded on the underwater vehicle.

A transformer loaded on a conventional underwater vehicle is a so-called winding transformer. This winding transformer has the property of increasing in size and weight in proportion to an increase in power consumption.

Meanwhile, on the underwater vehicle, a propeller such as a thruster, observation devices such as an underwater camera and sonar, and an operational device such as a manipulator, and the like, are loaded. It is preferable in terms of obtaining a favorable operating environment to increase a loading amount and variety of those devices since it leads to enhancement of searching performance and the like.

However, there is a limit (payload limit) to weight of devices loadable on the underwater vehicle, including the winding transformer. When the number of loaded devices increases, not only the weight but also power consumption increases. With that increase, the winding transformer is increased in size and weight. It is therefore practically difficult to increase the loading amount of the devices within the payload limit range.

SUMMARY OF THE INVENTION

The present invention was made in view of the actual condition as thus described, and has an object to provide a power unit of an underwater vehicle, which is capable of reduction in size and weight of a transformer for stepping down power voltage of a power supply to increase a loading amount of devices within a prescribed limit so as to provide a favorable operating environment.

The present invention provides a power unit of an underwater vehicle, which is connected to a power supply through a cable and receives a power supply through the cable, wherein the power unit comprises an electronic transformer having: a rectifier for converting a high-voltage alternate current power of the power supply into a direct current; a high-frequency converter for converting an output of the rectifier into a high-frequency alternate current; a transformer for stepping down an output voltage of the high-frequency converter; a rectifier for converting an output of the transformer into a direct current; and a control circuit for controlling the high-frequency converter.

According to this, since the electric transformer is used for stepping down an alternate current voltage of the power supply, it is possible to configure the transformer so as to have a small size and weight as compared with the conventional winding transformer even if power consumption increases. This makes it possible to increase a loading amount of a variety of devices with respect to the underwater vehicle within a prescribed limit to enhance performance of search by the use of the variety of devices, so as to make the operating environment favorable.

It is preferable that the electronic transformer be stored in a storage container, and immersed in insulating oil within the storage container.

According to this, it is possible by the use of the insulating oil to suitably promote heat release of the electronic transformer to water outside the storage container, and to protect the devices from the sea water in the unlikely case of intrusion of the sea water.

DETAILED DESCRIPTION OF THE PREFERRED EMBODIMENT

Figure 1:
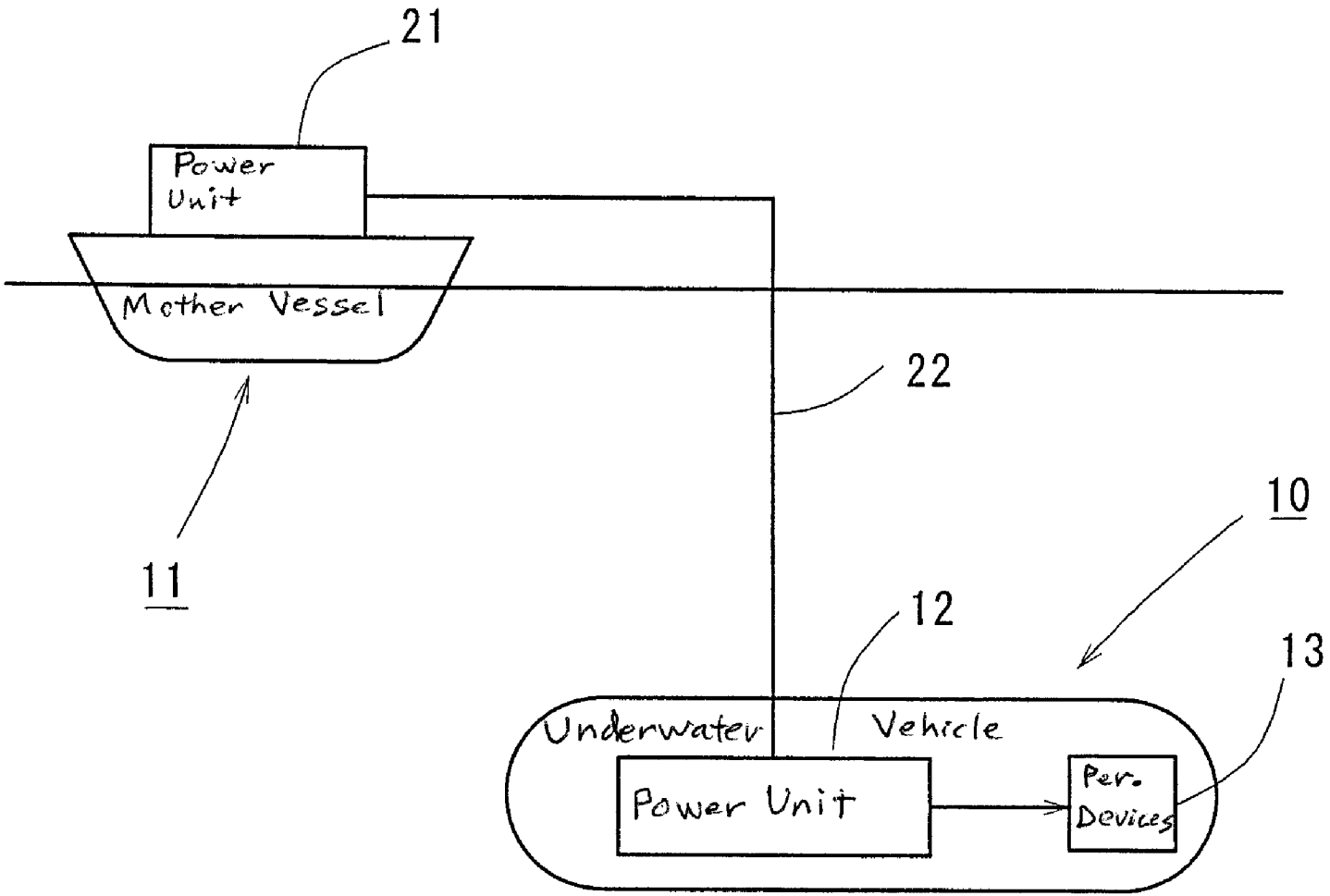
FIG. 1 is a schematic view showing an underwater vehicle according to an embodiment of the present invention and a mother vessel which conveys and operates the underwater vehicle.

In the following, an embodiment of the present invention is described with reference to drawings. FIG. 1 shows an underwater vehicle 10 according to the present invention and a mother vessel 11 which conveys and operates the underwater vehicle 10. A power unit (power supply) 21 is loaded on the mother vessel 11, and a power unit 12 of the underwater vehicle 10 is connected to the power unit 21 of the mother vessel 11 through a cable 22. The power unit 12 of the underwater vehicle 10 is powered by the power unit 21 of the mother vessel 11 through the cable 22.

It is to be noted that the underwater vehicle 10 may be an unmanned underwater vehicle or a manned underwater vehicle. Further, a cable other than the cable for power, such as a cable for communication, may be provided as the cable 22.

The power supply of the mother vessel 11 is, for example, an alternate current power supply of a high voltage of several thousands of volts. The voltage is made high so as to make a value of a current flowing through the cable 22 low. For this reason, for example, even in a case where the underwater vehicle is located at a great depth and thus the cable 22 is extremely long, voltage drop (power loss) due to resistance of the cable can be reduced, and the cable can be made thin.

On the underwater vehicle 10 loaded is a variety of peripheral devices 13 which include a propeller such as a thruster, an illumination lamp, observation devices such as an underwater camera and sonar, and an operational device such as a manipulator. These peripheral devices 13 are operated by power from the power unit 12 loaded on the underwater vehicle 10.

The power unit 12 has the function (voltage transformation function) of receiving a power supply from the power unit 21 on the mother vessel and transforming the received power into a voltage or the like suitable for the peripheral devices 13.

Figure 2:
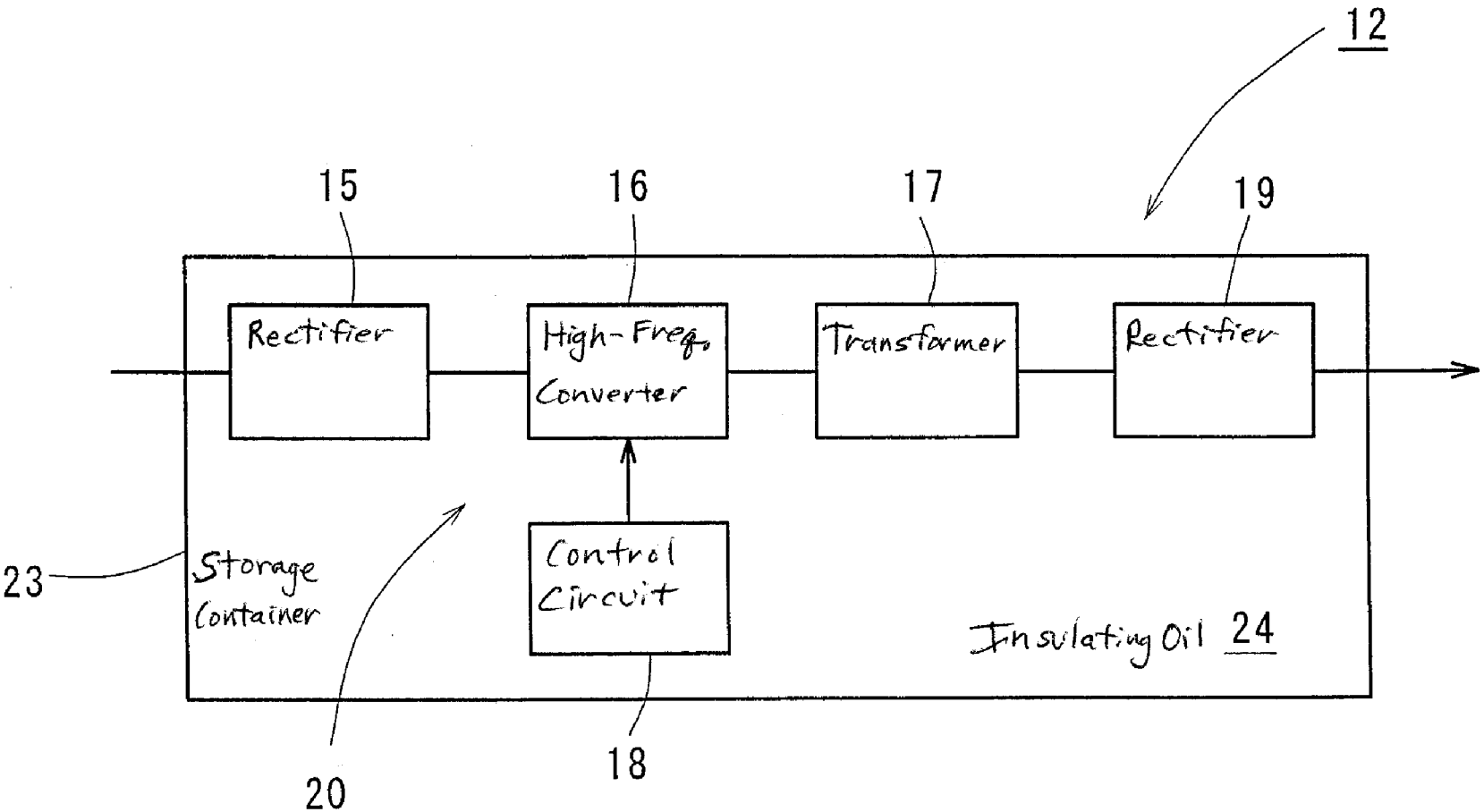
FIG. 2 is a schematic view showing a detail of a power unit of the underwater vehicle.

FIG. 2 is a schematic view showing a detail of the power unit 12 of the underwater vehicle 10. The power unit 12 comprises an electric transformer 20 having a rectifier 15, a high-frequency converter 16, a transformer 17, a control circuit 18, a rectifier 19 and the like.

The rectifier 15 has the function of converting alternate current power, transmitted from the mother vessel 11 through the cable 22, into a direct current, and for example includes a rectifying diode, a smoothing capacitor, and the like.

The high-frequency converter 16 has the function of converting the direct current power, converted by the rectifier 15, into a high-frequency alternate current. This high-frequency converter 16 is composed of a switching circuit, an inverter circuit and the like, and switches on/off (conducts/does not conduct) an input of the direct current from the rectifier 15 by means of a switching element such as an IGBT, to form a high frequency of about several hundreds Hz to several kilos Hz. This high-frequency converter 16 is controlled by a control signal of the control circuit 18.

The transformer 17 has the function of stepping down the alternate current voltage, with the frequency thereof made high by the high-frequency converter 16, to 100, 200 volts or the like. The rectifier 19 has the function of rectifying the stepped-down alternate current power into a direct current, and this rectified direct current power is supplied to the device 13 such as the thruster. The rectifier 19 also includes a rectifying diode, a smoothing capacitor, and the like.

According to the power unit 12 of the underwater vehicle 10 in the present embodiment, the electric transformer 20 having the above-mentioned configuration is used to convert a direct current after rectification into a high-frequency alternate current before performing voltage transformation by the transformer 17, whereby the transformer 17 can be made small in size and weight compared with the conventional winding transformer.

It is therefore possible to increase a loading amount of observation devices and the like within a payload limit range to allow performance of a variety of searches and the like so as to obtain a favorable operating environment. Further, even when the size and weight of the transformer 17 are made small, it is possible to make a power supply required according to an increase in power consumption.

As shown in FIG. 2, the electric transformer 20 is stored into a metal storage container 23, and immersed in insulating oil 24 within the storage container 23. The use of this insulating oil 24 enables promotion of heat exchange with water (sea water) outside the container 23 for favorable heat release of the electric transformer 20, and also enables protection of the devices from the sea water in the unlikely case of intrusion of the sea water.

The present invention is not limited to the above-mentioned embodiment, and the design thereof is suitably changeable within the range of the claims. For example, the location of the power supply is not limited to being on the mother vessel (on the water, on the sea), but the location may be on the ground.

What is claimed is:

1. A power supply system for supplying power in an underwater vehicle, from a mother vessel, the power supply system comprising:

an alternate current power supply;

a cable for transmission;

a first rectifier for rectifying a high-voltage alternate current power through the cable from the alternate current power into a direct current;

a high-frequency converter for converting an output of the rectifier into a high-frequency alternate current;

a transformer for stepping down an output voltage of the high-frequency converter;

a second rectifier for rectifying an output of the transformer into a direct current; and a control circuit for controlling the high-frequency converter, wherein the mother vessel comprises the alternate current power supply, the underwater vehicle comprises the first rectifier, the high-frequency converter, the transformer, the second rectifier and the control circuit, and the cable connects the mother vessel and the underwater vehicle, wherein the first rectifier, the high-frequency converter, the transformer, the second rectifier and the control circuit are stored in a storage container, and immersed in insulating oil within the storage container, wherein the first rectifier is connected to the high-frequency converter, the high-frequency converter is connected to the transformer, and the transformer is connected to the second rectifier, in a linear arrangement, wherein the control circuit is connected to the high-frequency converter laterally from the linear arrangement.

* * * * *